United States Patent [19]

Wera et al.

[11] 4,223,690

[45] Sep. 23, 1980

[54] PORTABLE ENCLOSURE

[76] Inventors: Glenn P. Wera, 900 Locust, Apt. 2J, West Dundee, Ill. 60118; Billy J. Dutton, 514 Streamwood Blvd., Streamwood,, Ill. 60103

[21] Appl. No.: 42,726

[22] Filed: May 25, 1979

[51] Int. Cl.[3] ..... E04H 1/12

[52] U.S. Cl. ..... 135/5 B; 4/599; 135/8

[58] Field of Search ..... 135/5 B, 8, 1 R, 7, 135/5 R, 7.1 R; 4/145, 146, 149, 154; 312/3-6

[56] References Cited

U.S. PATENT DOCUMENTS

| | | | |
|---|---|---|---|
| 351,860 | 11/1886 | Glidden | 135/5 B X |
| 548,190 | 10/1895 | Grant | 135/5 B X |
| 675,060 | 5/1901 | Gartrell et al. | 135/5 B X |
| 827,753 | 8/1906 | Russegue | 135/8 X |
| 2,509,759 | 5/1950 | Church | 135/8 |
| 2,770,244 | 11/1956 | Carson | 135/8 |

FOREIGN PATENT DOCUMENTS

| | | | |
|---|---|---|---|
| 690817 | 7/1964 | Canada | 135/8 X |
| 474275 | 11/1913 | France | 135/8 |

*Primary Examiner*—J. Karl Bell
*Attorney, Agent, or Firm*—Paul W. Grauer

[57] ABSTRACT

A portable enclosure which may be erected upon uneven terrain in the outdoors where curtained compartments may be utilized as shower and dressing areas in recreational and camping environments.

10 Claims, 6 Drawing Figures

PORTABLE ENCLOSURE

BACKGROUND OF THE INVENTION

1. Field of the Invention

This invention relates primarily to portable enclosures and particularly to portable enclosures used for shower and dressing areas in recreational settings.

2. Description of Prior Art

Portable enclosures and similar tent-like structures have long been known, including cases where the structures are used primarily for shower and dressing purposes. Most of the known structures were designed prior to the advent of the recreational vehicle and camping activity now popular with the general public. Therefore, most of the prior structures while being technically portable and consisting of various pole and canvas arrangements were awkward to erect and somewhat bulky to store once they were dismantled. Many of the structures were designed to be semi-permanent structures to be erected upon, for instance a beach where the structure would be removed at the end of a summer season and were not designed to be erected and dismantled on a daily basis.

A limiting feature of many of the former structures resided in the fact that many of the support members were required to be driven into the ground so the structure would be stable from exterior forces such as the wind. Some prior art structures required guy wires and stakes to ensure stability. These features had some distinct disadvantages. First, the structure would necessarily require a rather level surface on which to be erected, since a sloping grade would cause the support structure to lean and become unstable corresponding to the grade of the terrain. Secondly, since some of the supporting members would need to be driven into the ground, it became necessary to locate the structure or enclosure in an area where the ground was relatively soft and would preclude erection in rocky areas or in areas consisting of a concrete or asphalt base such as might be found in park areas in certain cases. Finally, the act of driving stakes, posts, or stringing guy wires is time-consuming and difficult for many individuals attempting to erect such an enclosure.

Additionally, a review of the portable tent-like structures in the prior art will show that many of the structures were complex in design and time consuming to erect reflecting to some extent the intention that many of these structures, once erected, would not be dismantled on a daily basis. On the contrary, present day recreational vehicle and camping markets comprise a highly transient population which frequently moves from place to place on a daily basis and requires that the portable enclosures be erected, dismantled and stored in a matter of minutes.

SUMMARY OF THE INVENTION

Therefore, it is an object of the present invention to provide a portable enclosure for recreational use which is free standing and does not require stakes or posts to be driven into the ground.

Another object of the present invention is to provide a structure which may be assembled and disassembled in a matter of minutes and stored in a relatively compact container when not in use.

A further object of the present invention is to set forth an enclosure which is capable of being erected upon uneven terrain.

Finally, an object of the present invention is to provide an enclosure with multiple compartments such that the compartments may be used both for shower and dressing areas.

Additional objects and features of the present invention will become apparent from the following detailed description, taken together with the accompanying drawings.

DESCRIPTION OF THE PREFERRED EMBODIMENT

Figure 1:
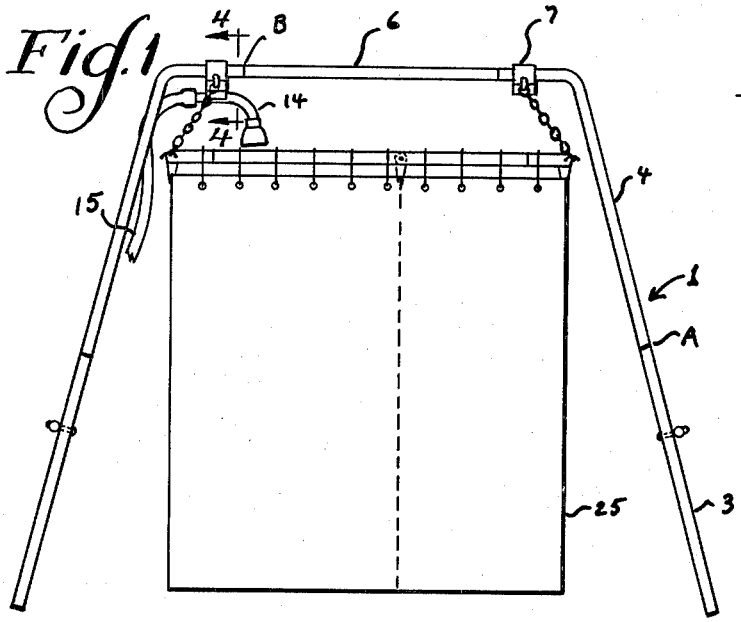
FIG. 1 is a side elevation view of the invention.
Figure 2:
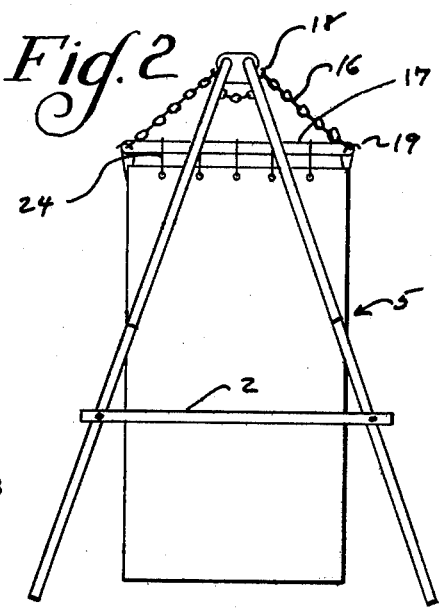
FIG. 2 is an end elevation view.
Figure 3:
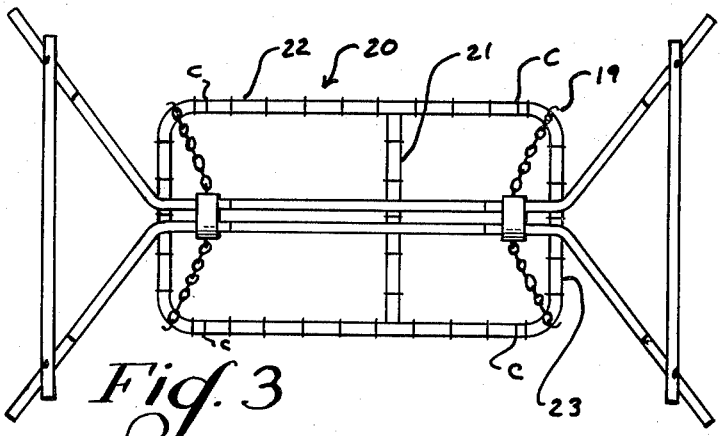
FIG. 3 is a top plan view.

Referring now to FIG. 2, there is shown a side view of a preferred embodiment for the portable enclosure. There are four main support members 1 standing essentially upright two of which are located on each side of the enclosure and are restrained in the lateral direction by a cross-member 2 which is pinned in a conventional manner to two of the main support members 1 on each side. In the preferred embodiment, each of the four main support members 1 comprises a multiplicity of shorter support members joined together by joint means and in particular, a lower support member 3 and an upper support member 4 joined together by joint means 5. These lower support members 3 are angled in two planes with respect to a perpendicular to the ground and are then connected to upper support members 4 which maintain and extend the same angle towards the upper portion of the enclosure. The lower support member 3 and the upper support member 4 are joined together at joint A through a known method whereby one of the members is reduced diametrically over three or four inches of its length such that it can be inserted into the inside diameter of the mating member. Joint A shown in FIG. 2 represents such a union of the lower support member 3 and the upper support member 4 as well as Joint B shown in FIG. 1 which represents a similar joint configuration between the lateral support member 6 and the horizontal portion of the upper support member 7.

Figure 6:
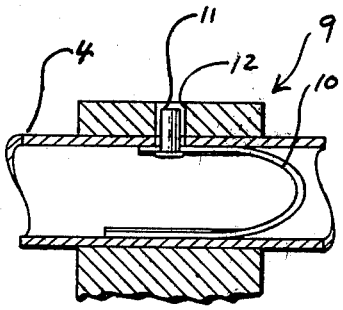
FIG. 6 is a cut-away view of the upper support member showing the detailed configuration of the detent mechanism.

Now referring to FIG. 1, it can be seen that as the upper support members 4 extend toward the top of the enclosure, they are bent at an angle of approximately 73 degrees from their initially straight position and extend in a horizontal direction until they meet Joint B and then proceed to form a lateral support member 6 which proceeds in a horizontal direction until it meets Joint B on the opposite side of the enclosure. Referring still to FIG. 1, it can be seen that the upper support members 4 and the other members connected to the upper support members 4 are held in a fixed position by the limiter blocks 7 which are shown in detail in FIG. 4, thus there is provided means for connecting the limiter blocks 7 to the lateral support members 6. First, the horizontal portion of the upper support members 4 are passed through the openings 8 in the limiter block 7 and are therefore restrained in their movement in a horizontal and vertical plane. Additionally, each of the upper support members 4 contains a detent means 9 which is shown in detail in FIG. 6. This detent means 9 consists of a spring 10 located inside the upper support member 4, which is connected to a detent 11 which passes through a hole in the upper support member. The detent 11 protrudes outside the upper support member such that it engages the elongated detent opening 12 in the limiter block 7 as the upper support member 4 is pushed into the limiter block 7. While the detent mechanism 9 can be depressed during disassembly, it has been found to be unnecessary, and the limiter blocks 7 may remain positioned on the upper support members 4 during normal storage.

Figure 4:
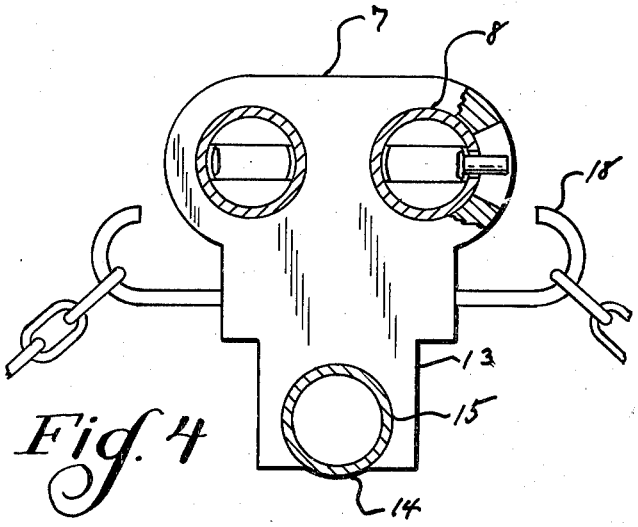
FIG. 4 is a side detailed view of the limiter block.
Figure 5:
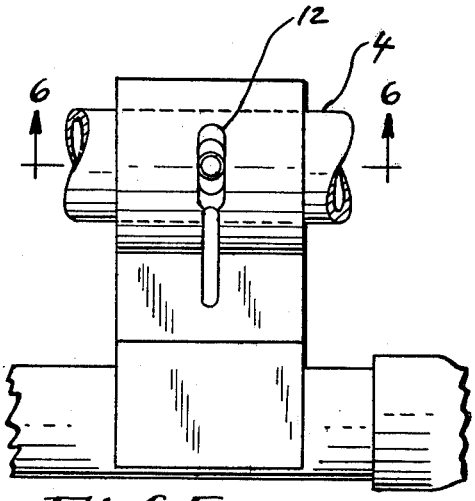
FIG. 5 is a front detailed view of the limiter block.

Referring to FIG. 5, the upper support member 4 is passed through the limiter opening 8, and the detent 11 is depressed by the assembler such that the detent 11 passes through the limiter opening 8 and is released into the detent opening 12 which is shown as an elongated hole in FIG. 5. Once this is accomplished the upper support member 4 is not only restrained in the horizontal and vertical directions but is also limited in the rotational plane to the range of a predetermined angle by the restriction of the detent 11 movement within the elongated detent opening 12. This limitation of rotation of the upper support members 4 together with the members that connect to the upper support member 4 is of great advantage when attempting to assemble the enclosure since it predetermines the angles that the support members will assume with respect to one another; and it also makes the enclosure easier to assemble since the members are somewhat restricted in their movement. FIGS. 4 and 5 show the detent 11 in an intermediate position such as when the structure was being assembled. The detent 11 would rotate to the top of the elongated opening 12 when the main support members 1 were fully spread open as shown in FIG. 2.

Referring again to FIG. 4, it can be seen that at the bottom of the limiter block 7 there is shown a shower head bracket 13 which in the preferred embodiment is fixed permanently to one of the limiter blocks 7, thus providing a means for attaching a shower head 14 to the enclosure so that the shower can spray into one of the compartments. Note that the shower head bracket 13 is open at its lower portion so that the hose 15 for the shower head 14 can be passed through this opening, and then the shower head 14 itself can be held by the shower head bracket 13.

In FIG. 2 it will be noted that a multiplicity of adjustable length 16 members, such as chains, are connected between the limiter blocks 7 and the curtain support members 20. The limiter blocks 7 are provided with upper hooks 18 which are fixed to the limiter block 7 by conventional means as shown in FIG. 4. The lower hooks 19 are located in approximately the corners of the curtain support frame 20. In the preferred embodiment, the curtain support frame 20 comprises a multiplicity of support members joined together by joint means and in particular, a divider member 21, and two straight curtain support members 22 and two bent curtain support members 23 wherein the straight and bent curtain support members are fastened at Joint C in a known manner similar to the manner described for Joints A and B above. The divider member 21 is connected perpendicular to each straight curtain support member 22 and provides a means whereby a curtain 25 may be hung from curtain rings 24 and separate the enclosure into separate compartments, as shown in FIGS. 1 and 2.

In the preferred embodiment, the divider member 21 may be moved laterally to adjust the size of the respective compartments depending upon the intended application for the portable enclosure. For purposes of the preferred embodiment, the main structure refers to the upper 4 and lower support members 3, cross-members 2 and lateral members 6 when they are joined together through the limiter blocks 7 in the assembled position. Once this main structure is assembled then the curtain support frame 20 may be suspended by the adjustable length members 16 or chains, as shown in FIG. 1, and thus there is provided means for connecting a portion of each corresponding adjustable length member 16 to a limiter block 7 and connecting an opposing portion to the curtain support frame 20. It can be seen that by adjusting the length of the chain 16 at each of the four corners of the curtain support frame 20 or at the upper hooks 18 of the limiter blocks 7 the assembler can easily adjust the relationship of the curtain support frame 20 to the main structure such that the curtain 25 hanging from the curtain rings 24 which are connected to the curtain support frame 20 match the surrounding terrain. In other words, by adjusting the chains 16 the assembler can adapt the portable enclosure to the ground conditions and grade found at the assembly site. The means for connecting the curtain 25 to the curtain support frame 20 in the preferred embodiment comprises a curtain 25 hung from curtain rings 24 which are in turn connected to the curtain support frame 20 in a conventional manner. The curtain 25 can have various openings, however, the preferred embodiment comprises a one piece curtain 25 which extends completely around the outer perimeter of the curtain support frame 20 and then continues on across the divider member 21 with a slit or opening at the location where the divider member 21 connects to the curtain frame 20. This configuration of the curtain yields two separate compartments for the enclosure.

After the portable enclosure is completely assembled a shower head 14 connected to a hose 15 in a conventional manner may be mounted through the shower head bracket 13 shown in FIG. 5 such that the shower spray may be directed into the corresponding compartment, as shown in FIG. 1.

Referring again to FIGS. 1 and 2, it can be observed that the adjustable length member 16, such as a chain, is angled in two directions from a perpendicular to the ground thereby providing stability for the curtain support frame 20 and curtain 25 once it is in the assembled position.

From the above description it is seen that a portable enclosure is provided which adapts to the surrounding terrain and is stable in the assembled position but may be disassembled and stored conveniently.

Although the preferred embodiment of my invention has been described, it is to be understood that the present disclosure is made by way of example, and that variations are possible without departing from the scope of the claimed subject matter which I regard as my invention.

I claim:

1. A portable enclosure comprising: four main support members; two lateral support members; joint means for connecting the upper ends of two main support members to each corresponding lateral support member; a multiplicity of limiter blocks; means for connecting the limiter blocks to the lateral support members; a multiplicity of adjustable length members; a curtain support frame; means for connecting a portion of each corresponding adjustable length member to a limiter block and connecting an opposing portion to the curtain support frame; a curtain; means for connecting the curtain to the curtain support frame.

2. A portable enclosure as recited in claim 1, wherein: said limiter block restricts the rotational movement of the lateral support member to which it is connected to movement within the range of a predetermined angle.

3. A portable enclosure as recited in claim 1, wherein: said four main support members comprise a multiplicity of shorter support members joined together by joint means.

4. a portable enclosure as recited in claim 1, wherein: said curtain support frame comprises a multiplicity of support members joined together by joint means.

5. A portable enclosure as recited in claim 1, wherein: said means for connecting the limiter blocks to the lateral support members comprises a limiter opening and detent means.

6. A portable enclosure as recited in claim 1, wherein: said detent means comprises a spring loaded detent.

7. A portable enclosure as recited in claim 1, wherein: one limiter block includes a shower head bracket.

8. A portable enclosure as recited in claim 1, wherein: said curtain support frame includes one or more divider members connected to said frame.

9. A portable enclosure as recited in claim 1, wherein: said limiter blocks include an upper hook for connecting a portion of each corresponding adjustable length member to the limiter block.

10. A portable enclosure as recited in claim 1, wherein: one or more cross-members connect to said main support members.

* * * * *